US011339527B2

(12) United States Patent
Harris

(10) Patent No.: US 11,339,527 B2
(45) Date of Patent: May 24, 2022

(54) WASHABLE GARMENT CASE

(71) Applicant: Annie Metz Harris, Channelview, TX (US)

(72) Inventor: Annie Metz Harris, Channelview, TX (US)

( * ) Notice: Subject to any disclaimer, the term of this patent is extended or adjusted under 35 U.S.C. 154(b) by 70 days.

(21) Appl. No.: 16/905,993

(22) Filed: Jun. 19, 2020

(65) Prior Publication Data

US 2021/0395944 A1 Dec. 23, 2021

(51) Int. Cl.
*D06F 95/00* (2006.01)

(52) U.S. Cl.
CPC ..... *D06F 95/006* (2013.01); *D06F 95/004* (2013.01)

(58) Field of Classification Search
CPC .... D06F 95/006; D06F 95/002; D06F 95/004; D06F 95/008; A47G 25/14; A47G 2025/1492
USPC .... 206/292, 284, 286, 287, 287.1, 285, 288, 206/289; 383/39, 117
See application file for complete search history.

(56) References Cited

U.S. PATENT DOCUMENTS 2,002,638 A * 5/1935 Lee ..... A45C 3/004 206/289
2,804,898 A * 9/1957 Cox ..... D06F 95/006 383/97
3,073,367 A * 1/1963 Samara ..... A45C 9/00 383/97
3,422,867 A * 1/1969 Wu ..... D06F 95/006 383/66
3,489,194 A * 1/1970 Hoover ..... A45C 9/00 383/4
4,403,636 A * 9/1983 Lopez ..... A45C 3/00 190/901
4,901,897 A * 2/1990 Briggs ..... A45C 3/004 206/287.1
4,960,204 A * 10/1990 Young ..... A45C 3/00 190/109
4,974,967 A * 12/1990 Tsuyoshi ..... D06F 95/006 383/102
5,320,429 A * 6/1994 Toyosawa ..... D06F 95/006 383/117
5,642,572 A * 7/1997 Manning ..... D06F 95/004 34/621
5,651,455 A * 7/1997 Garcia ..... A45C 3/00 206/287.1
6,471,054 B2 * 10/2002 Nevarez ..... A45C 7/0086 206/315.11
6,478,464 B1 * 11/2002 Miller ..... B65D 31/16 224/663
6,523,653 B2 * 2/2003 Roegner ..... A45C 3/00 190/109
6,742,683 B1 * 6/2004 Phan ..... D06F 95/006 223/84
7,334,941 B2 * 2/2008 Fenster ..... D06F 95/006 134/34

(Continued)

*Primary Examiner* — Nkeisha Smith
(74) *Attorney, Agent, or Firm* — Bruce A. Lev

(57) ABSTRACT

An improved case for washing garments including inner fasteners configured for use in releasably attaching and washing facial masks or bras or other garments to provide a practical means of securing them when tossed into a washing machine, thereby protecting their delicate materials and any fasteners and under-wires from the damage that can occur if they are placed directly into a machine.

19 Claims, 8 Drawing Sheets

(56) References Cited

U.S. PATENT DOCUMENTS

| | | | | |
|---|---|---|---|---|
| 7,481,340 | B2 * | 1/2009 | Murphy | A47G 25/743 223/85 |
| 8,348,054 | B2 * | 1/2013 | Dragan | A45C 13/03 206/292 |
| 8,453,896 | B1 * | 6/2013 | Mansell | A45F 3/04 224/576 |
| 9,010,600 | B1 * | 4/2015 | Gleaton | F41C 33/041 224/556 |
| 9,051,682 | B2 * | 6/2015 | Allende | D06F 95/008 |
| 10,104,947 | B2 * | 10/2018 | Graham | A45C 3/004 |
| 10,927,494 | B1 * | 2/2021 | Sayarat | A47G 25/54 |
| 2002/0114539 | A1 * | 8/2002 | Strevey | A45C 3/004 383/13 |
| 2004/0047522 | A1 * | 3/2004 | Thibault | D06F 95/002 383/86 |
| 2005/0232519 | A1 * | 10/2005 | Grimes, Jr. | D06F 95/006 383/39 |
| 2007/0101950 | A1 * | 5/2007 | Medlin | A01K 15/02 119/792 |
| 2008/0042460 | A1 * | 2/2008 | Fuchs | A45F 5/102 294/150 |
| 2012/0024727 | A1 * | 2/2012 | Dragan | D06F 57/12 206/286 |
| 2013/0075288 | A1 * | 3/2013 | Bielski | D06F 95/006 206/278 |
| 2013/0212898 | A1 * | 8/2013 | Reynolds | A45C 13/40 34/239 |
| 2014/0109321 | A1 * | 4/2014 | Allende | D06F 95/008 8/137 |
| 2017/0215616 | A1 * | 8/2017 | Cunningham | D06F 95/008 |
| 2018/0131127 | A1 * | 5/2018 | Magness | H01R 13/5219 |

* cited by examiner

WASHABLE GARMENT CASE

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of laundry bags and more specifically to a specially designed laundry bag featuring inner fasteners configured for releasably attaching and washing facial masks or bras or other garments, to provide a practical means of securing and protecting these garments when tossed into a washing machine.

DESCRIPTION OF THE RELATED ART

For most people, completing laundry on a regular basis is a necessary household chore. Whether tossing a child's dirty baseball uniform into the wash before a big game; laundering bed linens for unexpected company; or simply washing soiled bath towels and washcloths for the next day's use, most people utilize a washing machine at least once. For those consumers with large families and children, laundry must be washed on a daily basis, simply in order to keep all household members in clean clothing. Because laundry is perhaps the most necessary of all household chores, a myriad of products have been introduced to make this task easier. Liquid detergents, stain guards, fabric softeners and bleach, as well as hampers, hangers and laundry baskets, are but a few of the many items consumers utilize while doing their laundry.

Unfortunately for female consumers there is one challenge associated with completing laundry that has not been adequately addressed by manufacturers. Specifically when washing one's undergarments, in particular bras, can be a tedious and difficult endeavor. Most bras are held in place around the upper body by way of coated metal or plastic snaps or fasteners positioned in either the front of the garment, between the breast cups, or on the back of the bra's banding. In addition, many types of bras are modified with under-wires that serve to lift and support the breasts during wear. Although necessary, this hardware can be easily compromised when washed in a traditional washing machine and dried in the dryer. Simply stated, the hooks and clasps that secure the bra about the body can easily catch on other garments in the machine, as well as in the drainage holes/air vents that pepper the walls of the washer and dryer drum. When this occurs, the fasteners can become irrevocably bent or break off completely, rendering the garment useless. Further, when the bra gets caught on other clothing or the walls of the machine, the bra itself can become hopelessly twisted, stretching the shoulder straps and cups and bending or snapping the under-wires.

Although there are small laundry bags available for washing delicate items, these bags offer little support to the bra loosely contained within, thus the bra can nonetheless become as twisted and damaged in the bag as it would if placed directly in the wash. Considering that even low-end bras can be quite expensive and high-end versions can cost anywhere between 60 to 100 and more, it is little wonder that caring for these accessories is a major concern. As can be imagined, purchasing an expensive new bra, only to ruin the garment by tossing it into the wash, can be an extremely frustrating experience.

Various attempts have been made to solve problems found in laundry bag device art. Among these are found in: U.S. Publication No. 2013/0075288 to Brian Bielski; U.S. Pat. No. 8,348,054 to Marinela Luminita Dragan; and U.S. Pat. No. 7,056,023 to Lena L Heidel. This prior art is representative of laundry bags for multiple undergarments including mesh fabric and with fasteners inside.

None of the above inventions and patents, taken either singly or in combination, is seen to describe the invention as claimed. Thus, a need exists for a reliable washable garment case specially designed and featuring inner fasteners configured for use in washing bras or facial masks or other garments to provide a practical means of securing them when tossed in a washing machine, and protecting their delicate materials and fasteners and any under-wires from the damage that can occur if placed directly into a machine.

BRIEF SUMMARY OF THE INVENTION

In view of the foregoing disadvantages inherent in the known laundry bag device art, the present invention provides a novel washable garment case. The general purpose of the present invention, which will be described subsequently in greater detail, is to provide a specially designed washable garment case featuring inner fasteners configured for use in washing facial masks or bras or other garments to provide a practical means of securing them when tossed in a washing machine, thereby protecting their delicate materials and any fasteners and under-wires from the damage that can occur if they are placed directly into a machine. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention constructed and operative according to the teachings of the present invention.

The various embodiments of the present invention will hereinafter be described in conjunction with the appended drawings, wherein like designations denote like elements.

DESCRIPTION OF THE PREFERRED EMBODIMENT

The embodiments of the present invention relate to a washable garment case featuring inner fasteners configured for use in washing facial masks, bras, or other garments to provide females a practical means of them when tossed in a washing machine, top thereby protect their delicate materials and any fasteners and under-wires from the damage that can occur if they are placed directly into a machine.

One of the more important aspects of the instant washable garment case is the two removable and vertically positioned tracks which are positioned side by side, several inches apart, within the interior of the case. These tracks provide structural support for garments when attached and thus prevent them from becoming tangled during the washing process. Being zipped shut, the mesh bag would cover and further contain all components.

Figure 1:
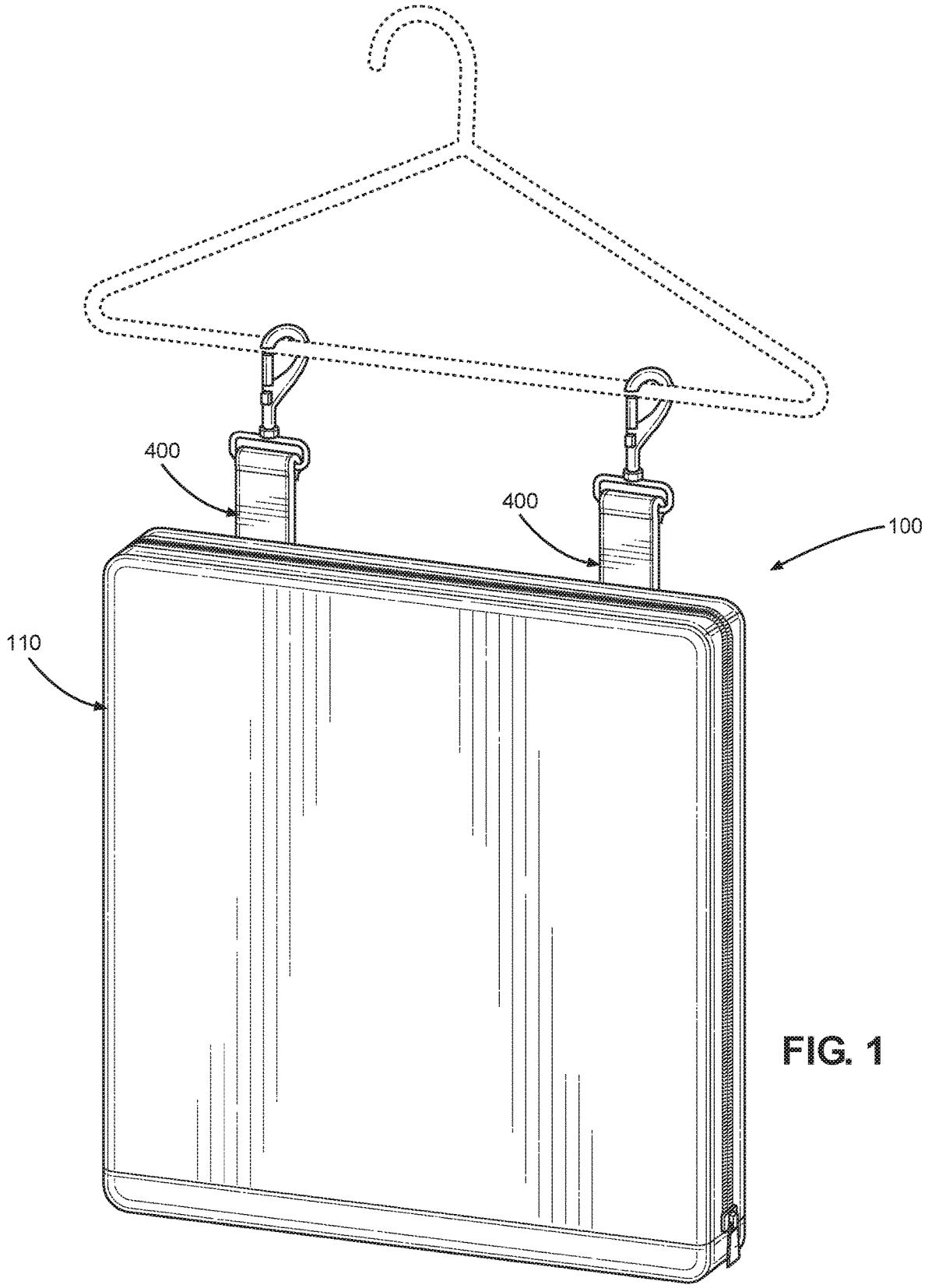
FIG. 1 shows a perspective view illustrating the washable garment case being hung from a support member according to an embodiment of the present invention.
Figure 2:
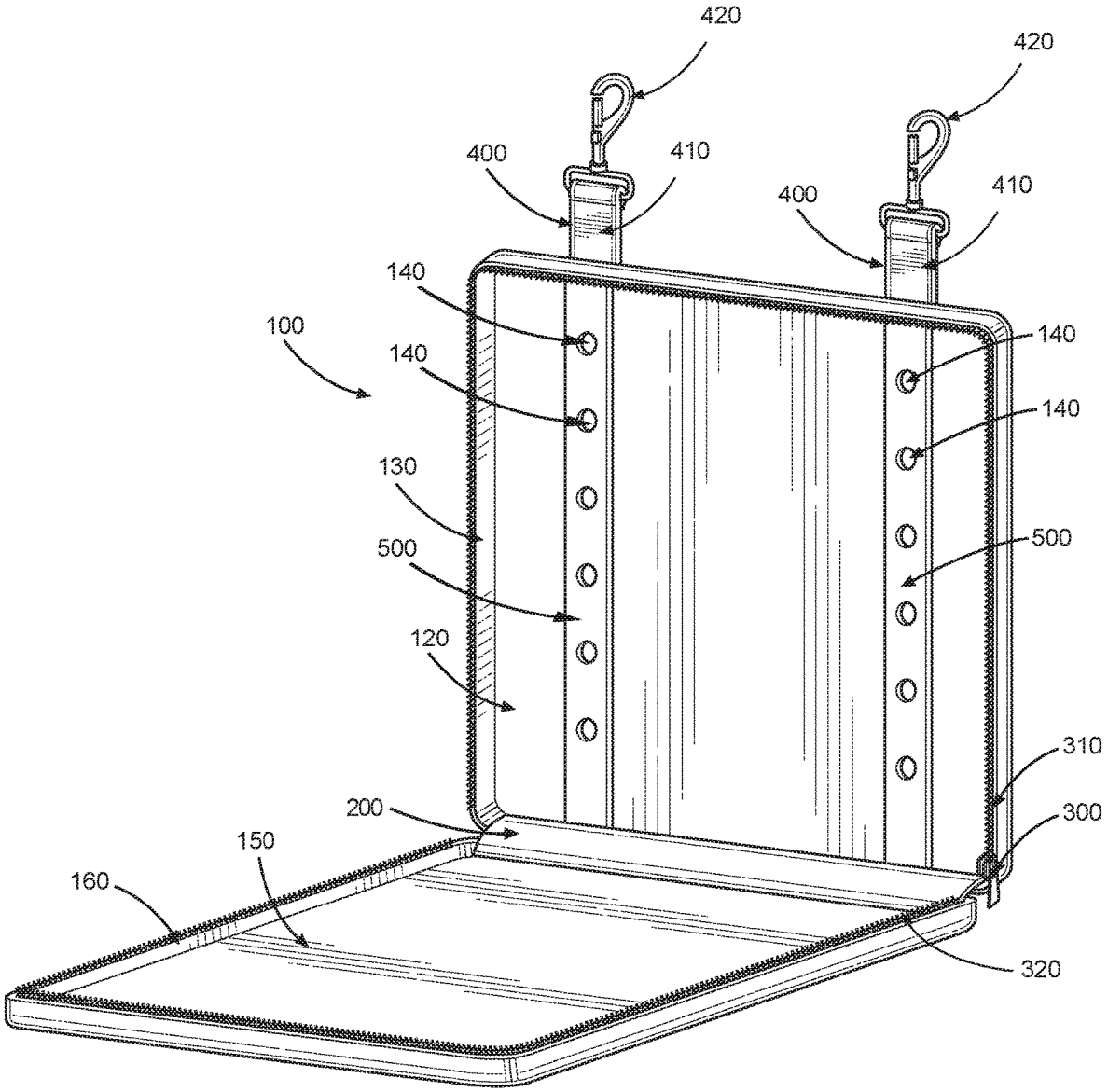
FIG. 2 shows a perspective view illustrating the washable garment case opened up and revealing the plurality of connectors on the first panel thereof according to the embodiment of the present invention of FIG. 1.

Referring now to the drawings, FIGS. 1 & 2 illustrate the improved washable garment case 100 comprising a main body 110 including a first panel 120 including an outer surface, an inner surface, an outer edge, and at least one side wall 130 extending substantially perpendicularly from the outer edge, and a plurality of connectors 140 connected to the inner surface and aligned such that they form two spaced columns and a plurality of equally spaced rows; and a second panel 150 including an outer surface, an inner surface, an outer edge, and at least one side wall 160 extending substantially perpendicularly from the outer edge, wherein the second panel is formed having a shape substantially similar to said first panel; a hinge 200 connected between the outer edge of the first panel and the outer edge of the second panel, wherein the first panel and the second panel are pivotally connected to one another via the hinge; a releasable connector 300 including a first connector portion 310 attached to the outer edge of the first panel; and a second connector portion 320 attached to the outer edge of the second panel, wherein the first connector portion and the second connector portion are adapted to be releasably connected to one another. The first panel and the second panel are adapted to form an interior volume when connected together via the releasable connector and the hinge. The washable garment case further incudes at least one attachment member 400 connected to the first panel member and is adapted to allow the case to be hung from a support member.

Figure 3:
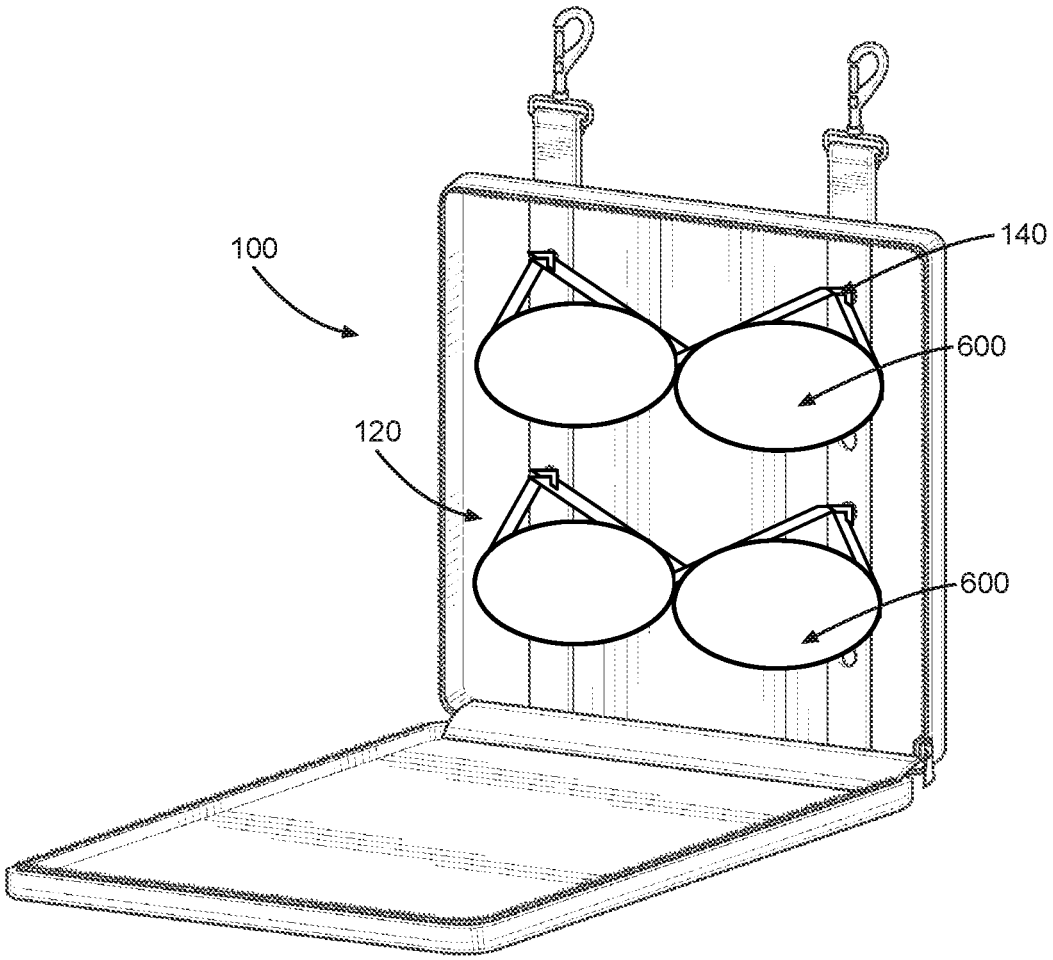
FIG. 3 shows a perspective view illustrating the washable garment case opened up and a plurality of bras attached to the connectors on the first panel according to the embodiment of the present invention of FIG. 1.

Referring to FIG. 3, the improved washable garment case 100 is shown with a plurality of bras 600 attached to the plurality of connectors 140 on the first panel first panel 120, such that when the case is closed and placed within a washing machine water and detergent are able to enter the interior volume of the case and wash the bras.

Figure 4:
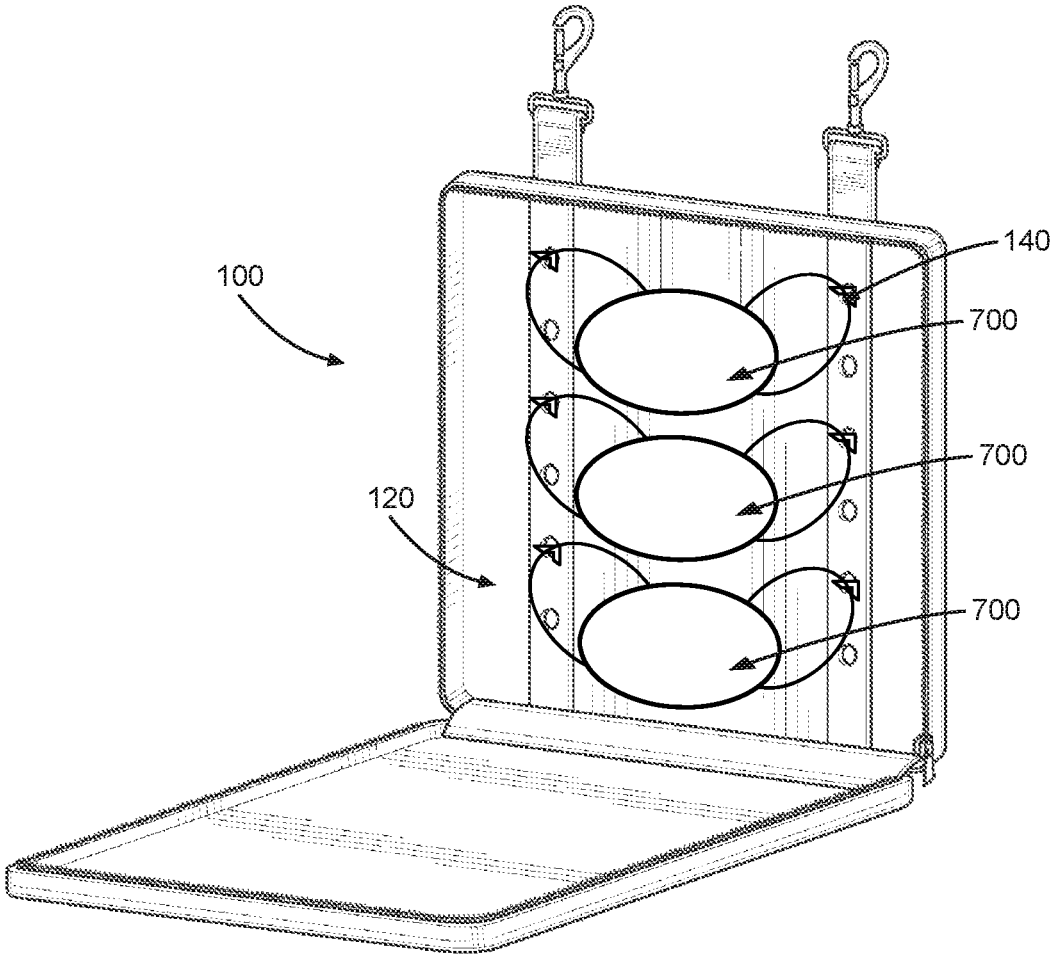
FIG. 4 shows a perspective view illustrating the washable garment case opened up and a plurality of face masks attached to the connectors on the first panel according to the embodiment of the present invention of FIG. 1.

Referring to FIG. 4, the improved washable garment case 100 is shown with a plurality of facial masks 700 attached to the plurality of connectors 140 on the first panel first panel 120, such that when the case is closed and placed within a washing machine water and detergent are able to enter the interior volume of the case and wash the facial masks.

Figure 5:
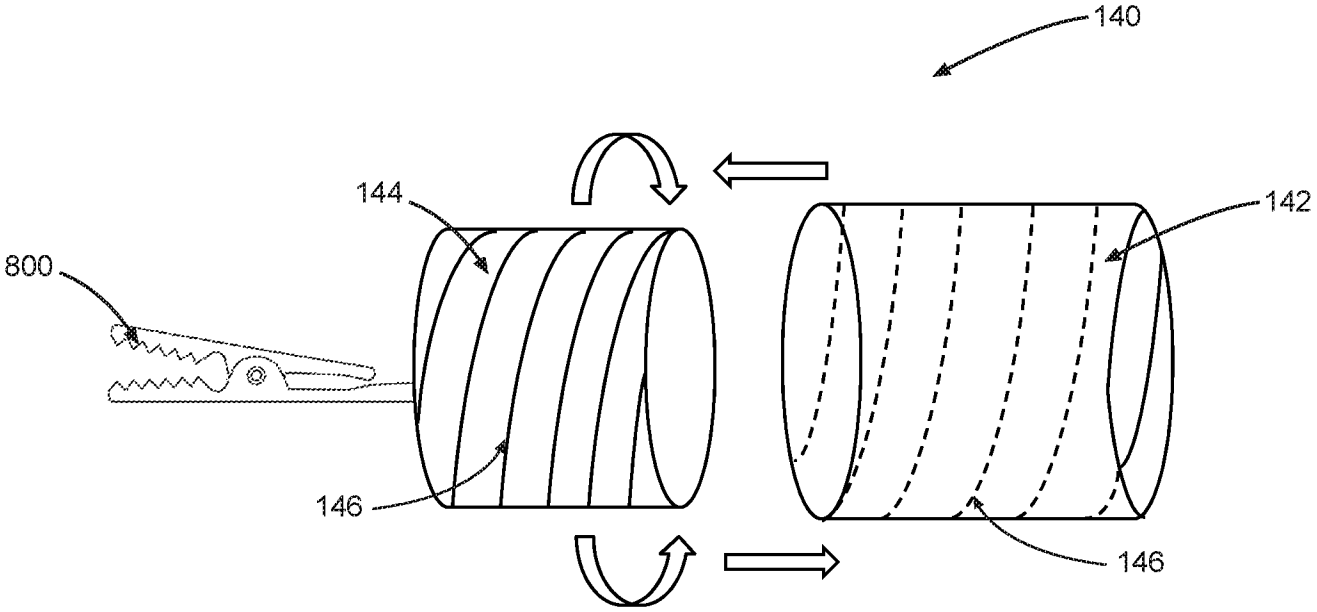
FIG. 5 shows a side view illustrating a connector incorporating screw portions and the releasable holder formed as a spring clip.

Referring to FIG. 5, the plurality of connectors 140 may be formed as screw fasteners comprising a first screw portion 142 attached to the inner surface of the first panel, and a second screw portion 144 including a releasable holder 800 adapted to releasably hold a garment thereto, wherein the second screw portion 144 is adapted to be releasably attached to a garment via the releasable holder 800 being formed as a spring clip, and wherein the second screw portion is adapted to be rotatably and removably connected to the first screw portion via threads 146 to thereby releasably attach the garment to said first panel.

Figure 6:
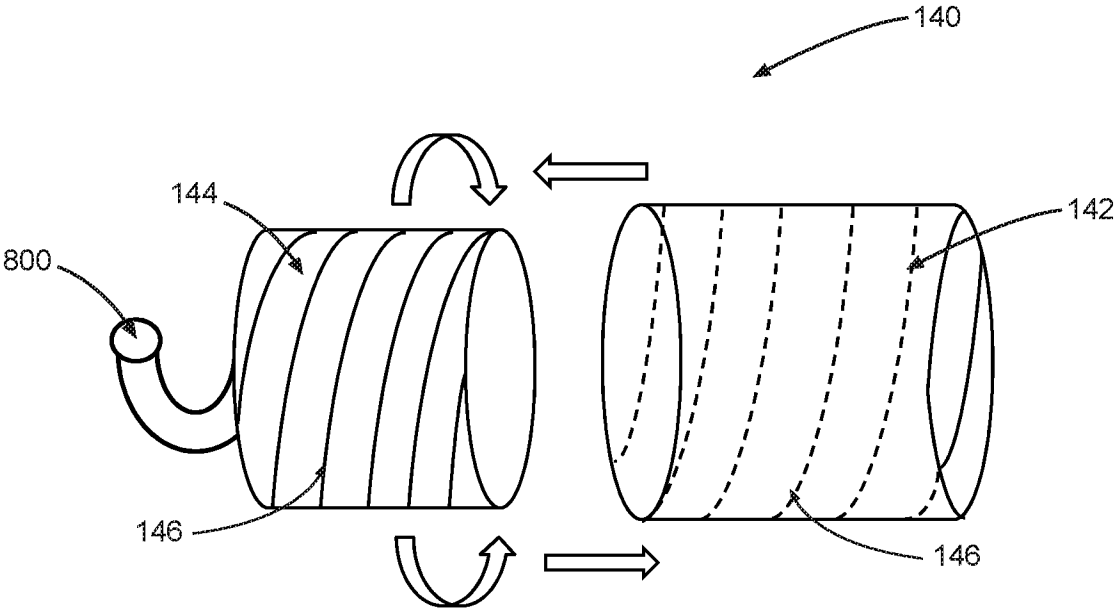
FIG. 6 shows a side view illustrating a connector incorporating screw portions and the releasable holder formed as a hook.

Referring to FIG. 6, the plurality of connectors 140 may be formed as screw fasteners comprising a first screw portion 142 attached to the inner surface of the first panel, and a second screw portion 144 including a releasable holder 800 adapted to releasably hold a garment thereto, wherein the second screw portion 144 is adapted to be releasably attached to a garment via the releasable holder 800 being formed as a hook, and wherein the second screw portion is adapted to be rotatably and removably connected to the first screw portion via threads 146 to thereby releasably attach the garment to said first panel.

Figure 7:
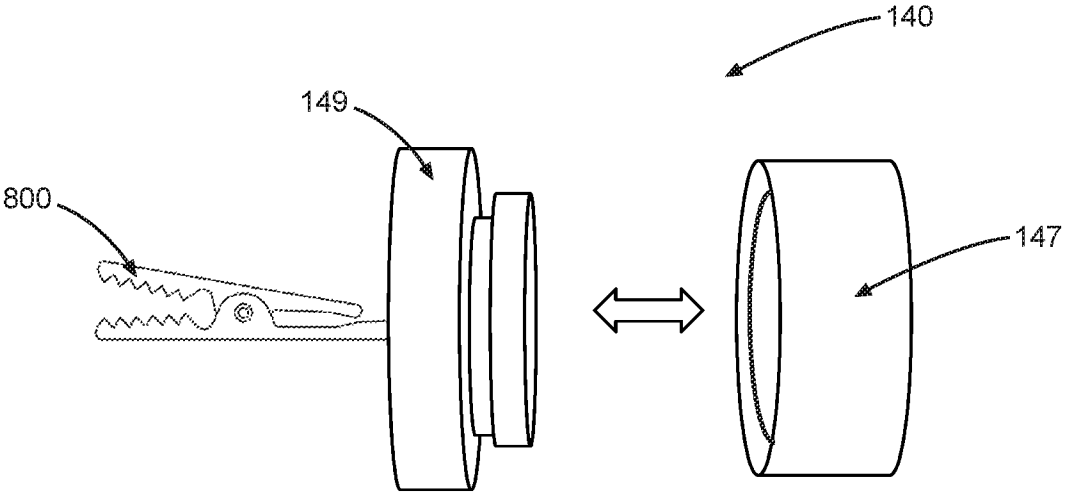
FIG. 7 shows a side view illustrating a connector incorporating snap portions and the releasable holder formed as a spring clip.

Referring to FIG. 7, the plurality of connectors 140 may be formed as snap fasteners comprising a first snap portion 147 attached to the inner surface of the first panel; and a second snap portion 149 including a releasable holder 800, formed as a spring clip, adapted to releasably hold a garment thereto, and wherein the second snap portion 149 is adapted to be removably and frictionally connected to the first snap portion 147 to thereby releasably attached the garment to the first panel.

Figure 8:
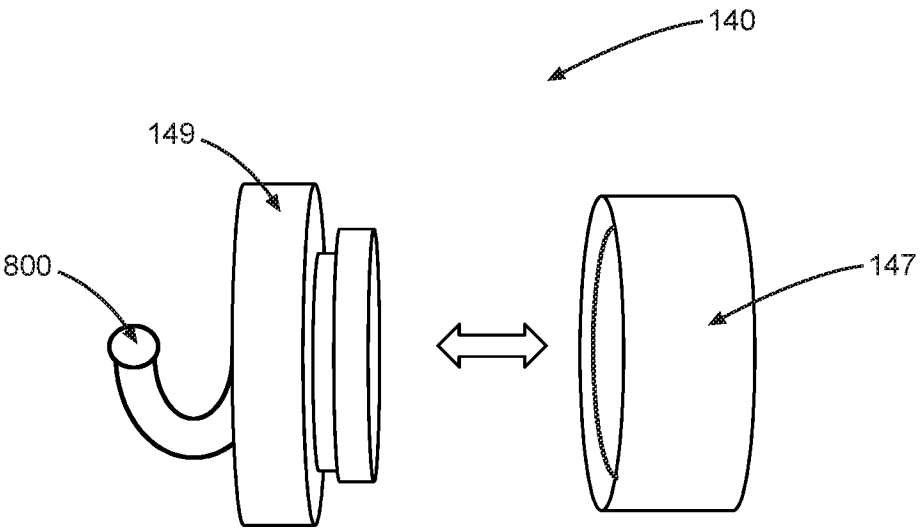
FIG. 8 shows a side view illustrating a connector incorporating snap portions and the releasable holder formed as a hook.

Referring to FIG. 8, the plurality of connectors 140 may be formed as snap fasteners comprising a first snap portion 147 attached to the inner surface of the first panel; and a second snap portion 149 including a releasable holder 800, formed as a hook, adapted to releasably hold a garment thereto, and wherein the second snap portion 149 is adapted to be removably and frictionally connected to the first snap portion 147 to thereby releasably attached the garment to the first panel.

The releasable connector 300 can be formed from hook and loop fasteners, but preferably as a zipper.

The inner and outer surfaces of the first and second panels may be formed from a permeable material, such as a mesh material, and formed from cotton, wool, nylon, burlap, copper, or stainless steel.

The at least one attachment member 400 may be formed including a strap 410 and a connector 420 attached to a distal end of the strap and is adapted to releasably connect to a support member. The connector 420 may be formed as a hook or a spring clip.

The first panel and the second panel may be formed having a rectangular shape, though other shapes and sizes may work equally as well.

The improved case may further comprise two elongated strap members 500 attached to the inner surface of the first panel and spaced apart from one another and positioned parallel to one another, and wherein each of the plurality of connectors 140 are attached to the inner surface of the first panel via a respective one of the two elongated strap members. Furthermore, the two elongated strap members 500 may have a length substantially equal to a length of the first panel member and may be adjustable in length.

The improved case is adapted to be used to retain and wash garments including bras and air filter facial breathing masks.

It should be noted that the steps described in the method of use can be carried out in many different orders according to user preference. The use of "step of" should not be interpreted as "step for", in the claims herein and is not intended to invoke the provisions of 35 U.S.C. § 112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved case for washing garments, comprising:
a main body including:
a first panel including:
an outer surface;
an inner surface;
an outer edge; and
at least one side wall;
wherein said at least one side wall extends substantially perpendicularly from said outer edge; and
a plurality of connectors;
wherein said plurality of connectors are connected to said inner surface;
wherein said plurality of connectors are aligned such that they form two spaced columns;
wherein said plurality of connectors are aligned such that they form a plurality of equally spaced rows; and
a second panel including:
an outer surface;
an inner surface;
an outer edge; and
at least one side wall;
wherein said at least one side wall extends substantially perpendicularly from said outer edge;
wherein said second panel is formed having a shape substantially similar to said first panel;
a hinge;
wherein said hinge is connected between said outer edge of said first panel and said outer edge of said second panel;
wherein said first panel and said second panel are pivotally connected to one another via said hinge;
a releasable connector including:
a first connector portion;
wherein said first connector portion is attached to said outer edge of said first panel; and
a second connector portion;
wherein said second connector portion is attached to said outer edge of said second panel;
wherein said first connector portion and said second connector portion are adapted to be releasably connected to one another;
wherein said first panel and said second panel are adapted to form an interior volume when connected together via said releasable connector and said hinge;
at least one attachment member;
wherein said at least one attachment member is connected to said first panel member and is adapted to allow said improved case to be hung from a support member; and
two elongated strap members;
wherein said two elongated strap members are attached to said inner surface of said first panel; and
wherein said two elongated strap members are spaced apart from one another and are positioned parallel to one another; and
wherein each of said plurality of connectors are attached to said inner surface of said first panel via a respective one of said two elongated strap members.

2. The improved case of claim 1, wherein said plurality of connectors are formed as snap fasteners comprising:
a first snap portion;
wherein said first snap portion is attached to said inner surface of said first panel; and
a second snap portion including:
a releasable holder;
wherein said releasable holder is adapted to releasably hold a garment thereto;
wherein said second snap portion is adapted to be releasably attached to a garment via said releasable holder; and
wherein said second snap portion is adapted to be removably connected to said first snap portion, to thereby releasably attached said garment to said first panel.

3. The improved case of claim 2, wherein said releasable holder is formed as a hook.

4. The improved case of claim 2, wherein said releasable holder is formed as a spring clip.

5. The improved case of claim 1, wherein said plurality of connectors are formed as screw fasteners comprising:
a first screw portion;
wherein said first screw portion is attached to said inner surface of said first panel; and
a second screw portion including:
a releasable holder;
wherein said releasable holder is adapted to releasably hold a garment thereto;
wherein said second screw portion is adapted to be releasably attached to a garment via said releasable holder; and
wherein said second screw portion is adapted to be rotatably and removably connected to said first screw portion, to thereby releasably attach said garment to said first panel.

6. The improved case of claim 5, wherein said releasable holder is formed as a hook.

7. The improved case of claim 5, wherein said releasable holder is formed as a spring clip.

8. The improved case of claim 1, wherein said releasable connector is formed from hook and loop fasteners.

9. The improved case of claim 1, wherein said releasable connector is formed as a zipper.

10. The improved case of claim 1, wherein said inner and outer surfaces of said first and second panels are formed from a mesh material.

11. The improved case of claim 1, wherein said two panels are formed from a material chosen from a list of materials consisting of cotton, wool, nylon, burlap, copper, and stainless steel.

12. The improved case of claim 1, wherein said at least one attachment member is formed including:

a strap; and a connector;

wherein said connector is attached to a distal end of said strap and is adapted to releasably connect to a support member.

13. The improved case of claim 12, wherein said connector is formed as a hook.

14. The improved case of claim 12, wherein said connector is formed as a spring clip.

15. The improved case of claim 1, wherein said first panel and said second panel are formed having a rectangular shape.

16. The improved case of claim 1, wherein said first panel and said second panel are formed from a permeable material.

17. The improved case of claim 1, wherein said two elongated strap members have a length substantially equal to a length of said first panel member.

18. The improved case of claim 1, wherein said two elongated strap members are adjustable in length.

19. The improved case of claim 1, wherein said improved case is adapted to be used to retain and wash garments chosen from a list of garments consisting of bras and air filter breathing masks.

* * * * *